US006013973A

United States Patent [19]

Sato

[11] Patent Number: 6,013,973

[45] Date of Patent: Jan. 11, 2000

[54] SPARK PLUG HAVING A SUB-COMBUSTION CHAMBER FOR USE IN FUEL IGNITION SYSTEMS

[76] Inventor: Jun Sato, 2607 W. Carson St., Torrance, Calif. 90503

[21] Appl. No.: 08/957,145

[22] Filed: Oct. 24, 1997

[51] Int. Cl.[7] ..... H01T 13/20

[52] U.S. Cl. ..... 313/143; 313/141; 313/143; 313/140

[58] Field of Search ..... 313/140, 141, 313/143; 123/266, 143 B

[56] References Cited

U.S. PATENT DOCUMENTS

| | | | |
|---|---|---|---|
| 1,596,240 | 8/1926 | Dikeman | 123/266 |
| 2,153,598 | 4/1939 | Steward | 313/141 |
| 4,452,189 | 6/1984 | Latch et al. | 123/143 B |
| 4,987,868 | 1/1991 | Richardson | 123/260 |
| 5,105,780 | 4/1992 | Richardson | 123/263 |
| 5,693,999 | 12/1997 | Osamura et al. | 313/141 |

*Primary Examiner*—Nimeshkumar D. Patel
*Assistant Examiner*—Joseph Williams
*Attorney, Agent, or Firm*—Lyon & Lyon LLP

[57] ABSTRACT

A spark plug for use in conventional fuel ignition systems includes a housing and a ground electrode attached to the housing. A center electrode is located within the housing and is spaced apart from the ground electrode to form an electrode gap. An insulation member electrically separates the center and ground electrodes. A sub-combustion chamber is further located on the spark plug and encloses the electrode gap. A plurality of holes are located within the walls of the sub-combustion chamber where both a fuel-air mixture and combustion gasses pass through.

9 Claims, 6 Drawing Sheets

SPARK PLUG HAVING A SUB-COMBUSTION CHAMBER FOR USE IN FUEL IGNITION SYSTEMS

BACKGROUND OF THE INVENTION

1. Field of the Invention

The field of the invention is spark plugs for internal combustion engines.

Spark plugs are used to ignite a mixture of fuel and air within a combustion engine. Typically, a spark plug conducts a high voltage from a terminal connection to an electrode positioned within a combustion chamber. During the compression stroke of the piston, a spark is created between this electrode and a ground electrode to ignite the fuel-air mixture.

Conventional spark plugs that are used in fuel ignition systems, however, suffer from a number of limitations. For example, during the compression stroke, when the piston compresses the fuel-air mixture, a non-uniform distribution of fuel and air is created. This non-uniform distribution of fuel and air poses problems for combustion engines, including, for example, decreased efficiency and increased emissions of unburned fuel.

Generally, as the fuel-air mixture is compressed, the mixture of fuel and air near the spark plug electrode is richer, or thicker than the surrounding gases. When the electrode of the spark plug discharges, the region containing the thicker mixture of fuel and air is the first to ignite. The flame then travels outward, along the inner surface of the combustion chamber where the mixture is thinner, i.e., leaner. Finally, the flame spreads to the main area of the combustion chamber, where the mixture of fuel and air is leanest.

Unfortunately, this mixture of fuel and air in the main combustion chamber takes longer than desired to finish burning. Consequently, this often results in the discharge of unburned fuel and air. This problem is more acute when the engine operates at high rotation speeds where it is increasingly difficult to finish burning before the next cycle. The unburned fuel thus lowers the fuel efficiency of the entire system.

The expulsion of unburned fuel possess numerous problems as well. For example, the release of fuel into the atmosphere is known to deleteriously affect the environment. As a result, prior to release in the atmosphere, this unburned mixture is often passed through a separate and expensive catalytic converter device.

Attempts have been made at encapsulating electrodes to improve ignition. However, these designs have also had numerous shortcomings such as large heat losses in the ignition period as well as problems associated with long term usage, i.e., oil burning and carbon deposition on the electrode. Moreover, these devices have altered compression ratios and prevented the self-cleaning of spark plug electrodes.

SUMMARY OF THE INVENTION

The present invention is directed to a spark plug for use in fuel ignition systems having a sub-combustion chamber. The sub-combustion chamber has an annular wall surrounding the electrode gap of the spark plug with a plurality of ejection holes.

In the first separate aspect of the present invention, the plurality of ejection holes are oriented laterally adjacent to the electrode gap of the spark plug. The arrangement provides uniform directional combustion from the spark plug.

In a second separate aspect of the present invention, the structure of the first aspect further includes a cap associated with the annular wall and including an axial hole therethrough to further define the sub-combustion chamber. The gap of the spark plug extends axially of the plug and the ground electrode is broadly shaped. This promotes lateral distribution of the combustion mixture from the electrode through the laterally adjacent ejection holes.

Accordingly, it is an object of the present invention to provide an improved spark plug employing a sub-combustion chamber. Other and further objects and advantages will appear hereinafter.

BRIEF DESCRIPTION OF THE DRAWINGS

FIG. 4(*b*) is a schematic view of a cylinder and associated piston during the compression cycle.

FIG. 4(*c*) is a schematic view of a cylinder and associated piston during the compression cycle.

FIG. 5(*b*) is a schematic view of a cylinder and associated piston during the discharge cycle.

FIG. 5(*c*) is a schematic view of a cylinder and associated piston during the discharge cycle.

FIG. 7(*b*) is a schematic view of a cylinder and associated piston during dead-center compression.

FIG. 7(*c*) is a schematic view of a cylinder and associated piston during dead-center compression.

DETAILED DESCRIPTION OF THE PREFERRED EMBODIMENT

Figure 1:
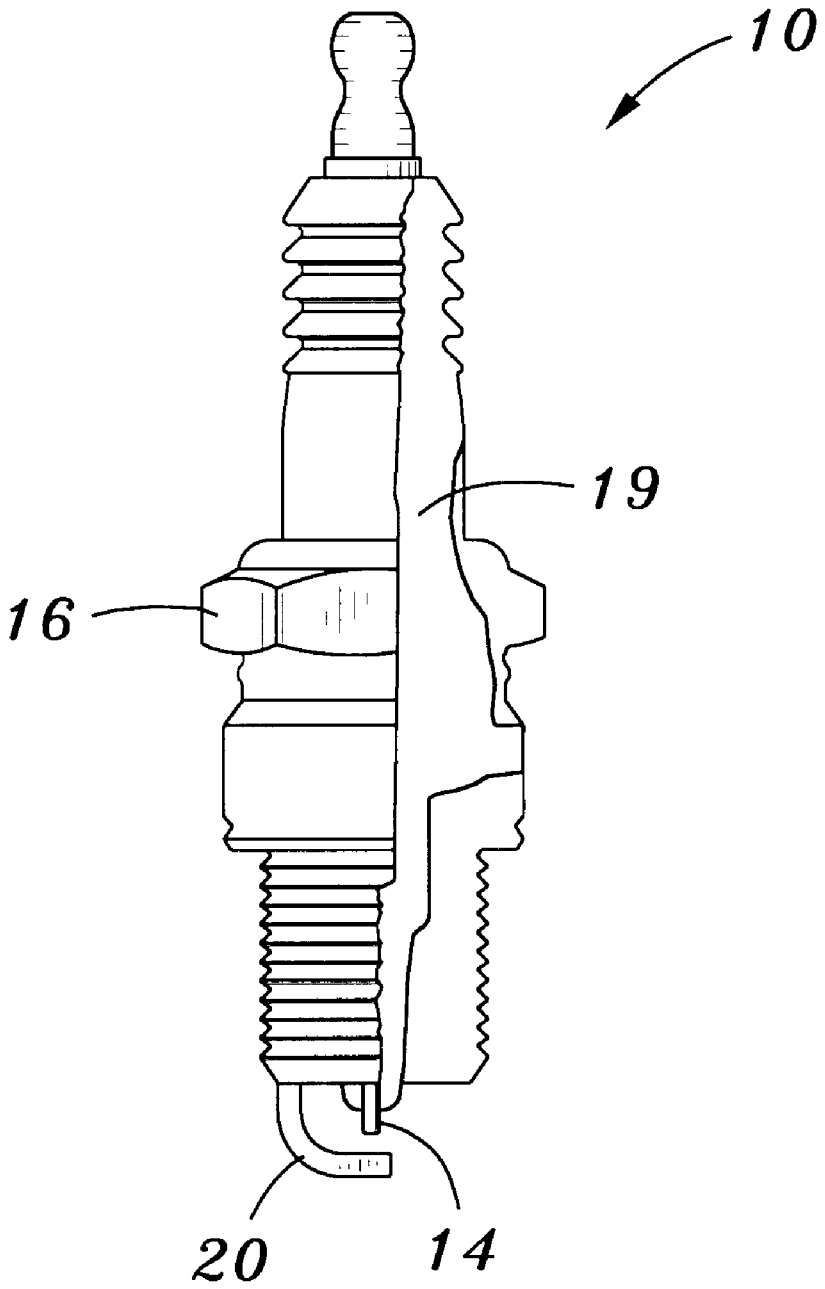
Fig. 1 (PRIOR ART)
FIG. 1 is a quarter section view of a conventional spark plug.

Turning now in detail to the drawings, FIG. 1 shows a conventional design for a spark plug 10 for use in fuel ignition engines. The spark plug 10 includes a housing 16, a center electrode 14, and a ground electrode 20 fixedly attached to the housing 16. An insulation member 19 electrically separates the ground electrode 20 and center electrode 14.

Figure 2:
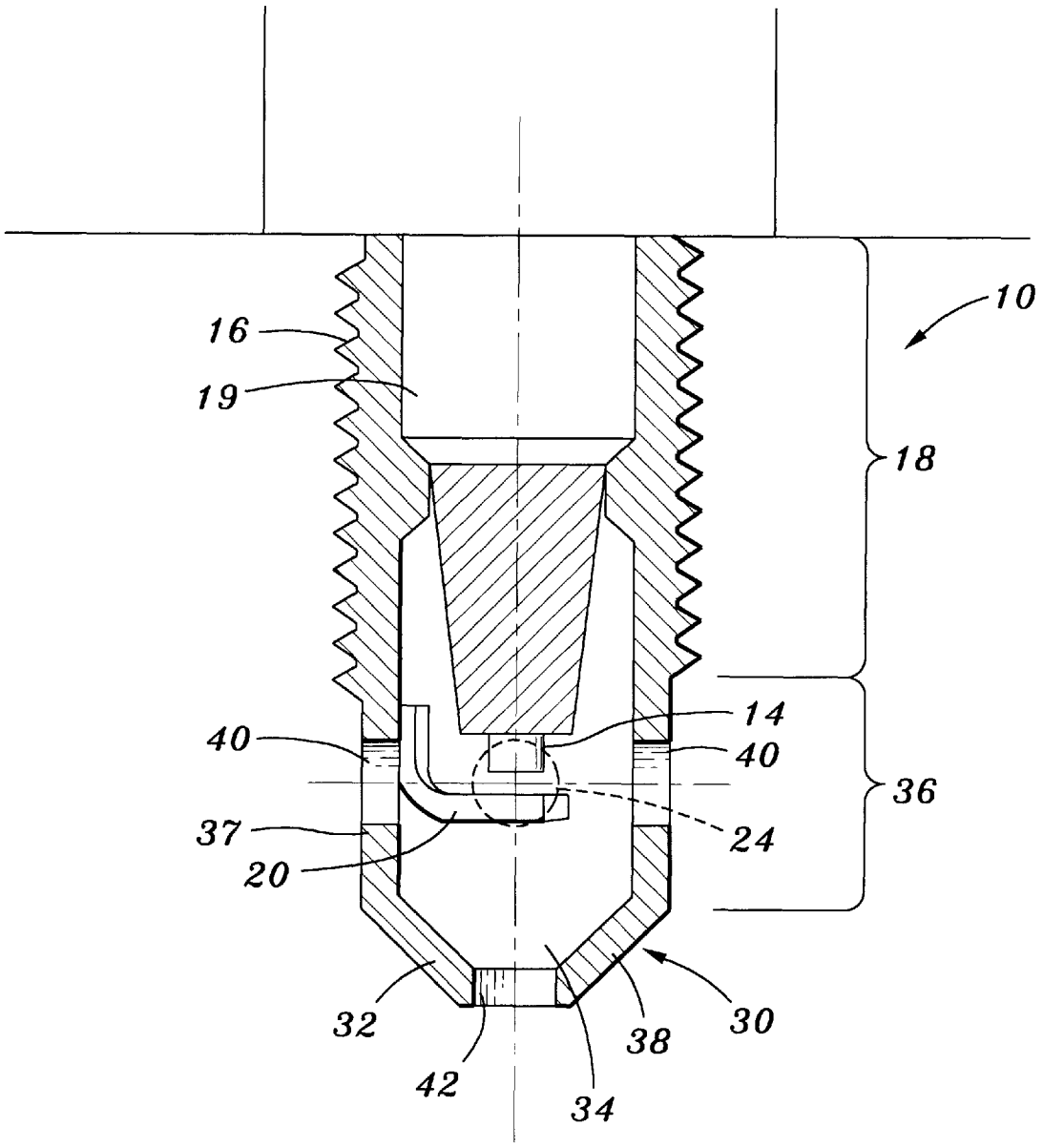
FIG. 2 is an enlarged cross-sectional view of a spark plug showing a sub-combustion chamber.
Figure 3:
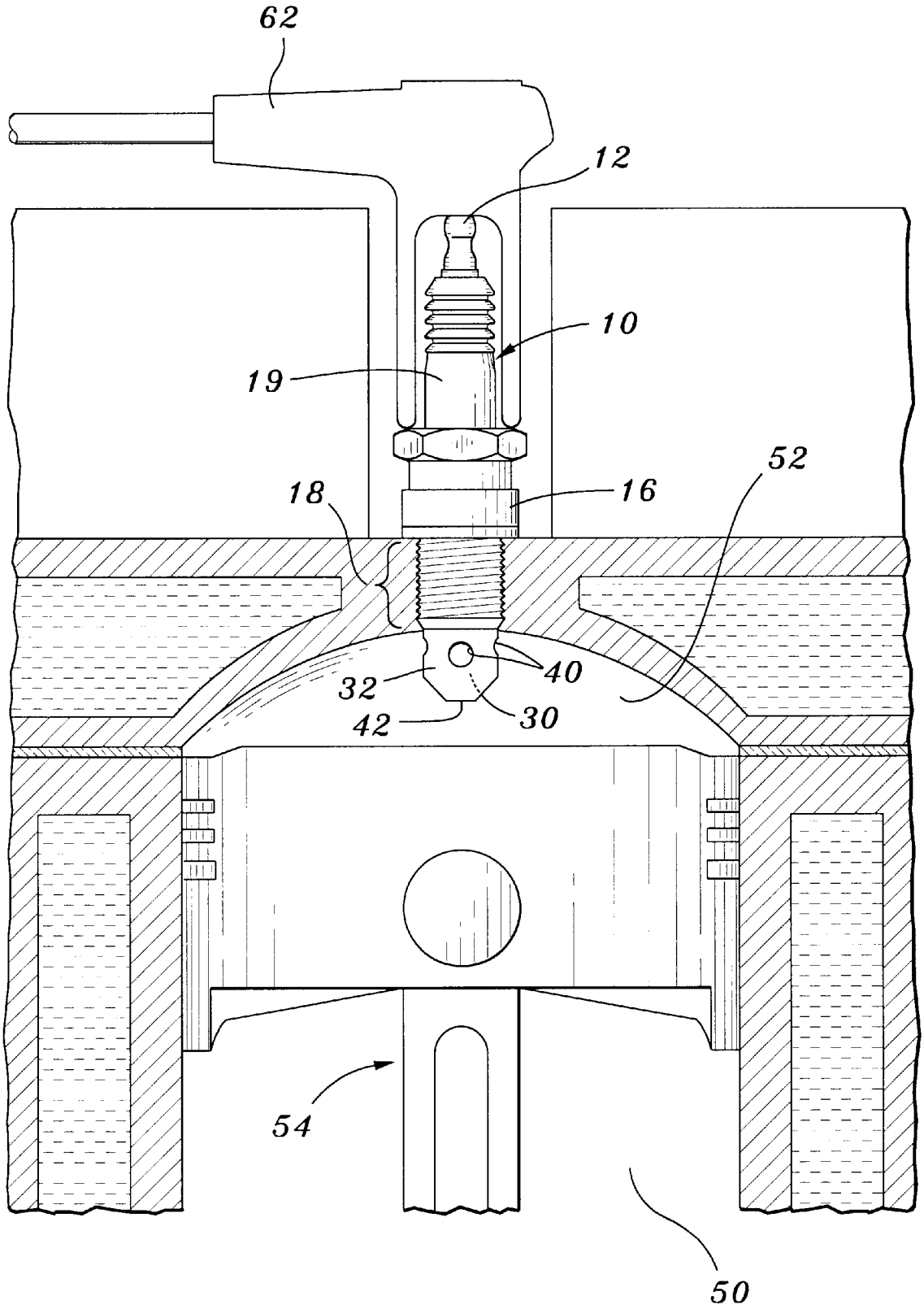
FIG. 3 is a cross-sectional view of an engine with the spark plug of FIG. 2 installed.

Referring now to FIGS. 2 and 3, one preferred embodiment of the invention is shown. The spark plug 10 includes a conductive terminal end 12 that connects to a high-voltage ignition coil (not shown). The conductive terminal end 12 is electrically connected to a center electrode 14 that is located axially within a housing 16 of spark plug 10. The center electrode 14 passes beyond a threaded region 18 of the housing 16. An insulation member 19 electrically separates the center electrode 14 from the housing 16 and the ground electrode 20.

Still referring to FIG. 2, an ground electrode 20 is fixedly attached to the housing 16 and bends toward the terminus of the center electrode 14. A electrode gap 24 is thus formed between the center electrode 14 and the ground electrode 20. The ground electrode 20 while fixedly attached to the housing 16 can preferably be adjusted to alter the width of the electrode gap 24. A sub-combustion chamber 30 is located below the housing 16. Preferably, the sub-combustion chamber 30 is located below the threaded portion 18 of the housing 16.

The sub-combustion chamber 30 includes walls 32 that are contiguous with the housing 16. The walls 32 of the sub-combustion chamber 30 create an ignition chamber 34, wherein combustion of the fuel-air mixture initiates. Preferably, the walls have a thickness from about 1.5 mm to about 2.5 mm with the most preferred being about 2 mm. The walls 32 advantageously have an annular section 36 and a cap 38, the annular section 36 being contiguous with the housing 16.

The annular section 36 preferably contains an annular wall 37 that circumferentially surrounds the electrode gap 24. In addition, a plurality of ejection holes 40 are disposed within the annular walls 37 of the sub-combustion chamber 30 such that the ejection holes 40 are preferably laterally adjacent to the electrode gap 24. The number of ejection holes 40 located in the wall 37 can range from two to four or more depending on the size of the spark plug. Generally, larger spark plugs 10 have a larger number of ejection holes 40. Preferably, the ejection holes are positioned circumferentially equidistant from one another to provide for maximum flame distribution during ignition.

While the ejection holes 40 are broadly stated as being laterally adjacent to the electrode gap 24, the ejection holes 40 are preferably located such that an imaginary plane passing through the electrode gap 24 perpendicular to the axis of the plug 10 intersects the ejection holes 40. The plane need not necessarily pass through the center of the electrode gap 24, but rather can reside anywhere therein. Consequently, the ejection holes 40 are substantially co-planer with the electrode gap 24. The ground electrode 20 preferably has a wide width to assist in directing the flame horizontally through the ejection holes 42 after ignition. Preferably, the ground electrode 20 has a width at its terminal end within the range of about 2.5 mm to about 3.5 mm. In addition, the ground electrode 20 preferably has a width at a terminal end thereof that is larger than the diameter of the center electrode 14. The size of the terminal end of the ground electrode 20 and the positioning of the ejection holes 40 advantageously distributes the flame laterally upon ignition. This advantageously increases the rate of burning of fuel-air mixtures within internal combustion engines. Moreover, the substantially co-planer location of the ejection holes 40 advantageously permit easy access to clean carbon deposits, oil, and the like from the electrode gap 24.

The cap 38 of the sub-combustion chamber 30 tapers into a single ejection hole 42. Preferably, this ejection hole is the only hole in the cap 38. In addition, this single ejection hole 42 is preferably aligned axially with the centerline of the sparkplug 10. The taper angle of the cap 38 advantageously creates a region of high pressure within the sub-combustion chamber 30 to direct the rich fuel-air mixture into a main combustion chamber 52. The angle of the taper can range from about 45° to about 60° depending on the locations and angles between the intake valve 56 and exhaust valve 58.

The ejection holes 40 and 42 preferably have an inner diameter ranging from about 3.0 mm to about 4.0 mm. The optimum diameter of the ejection holes 40 and 42 is preferably about 3.5 mm.

Referring now to FIG. 3, the spark plug 10 is located within a cylinder 50. The cylinder 50 further includes a main combustion chamber 52 and a piston 54.

As can be seen from FIG. 3, when the spark plug 10 is securely screwed into place, the sub-combustion chamber protrudes into the main combustion chamber 52. Moreover, the ejection holes 40 and 42 are advantageously positioned within the main combustion chamber 52.

Figure 4A:
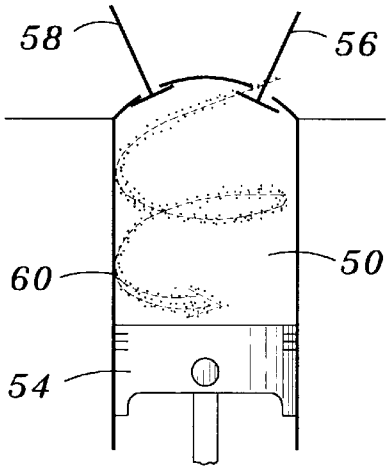
FIG. 4(*a*) is a schematic view of a cylinder and associated piston during the intake cycle.
Figure 4B:
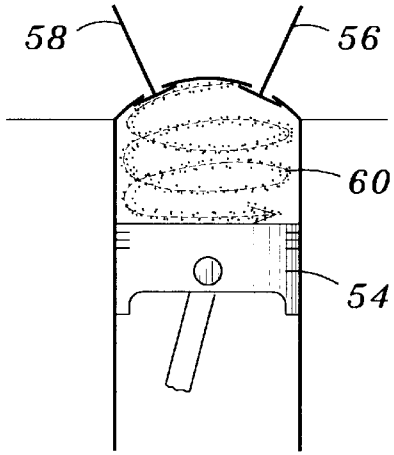
Figure 4C:
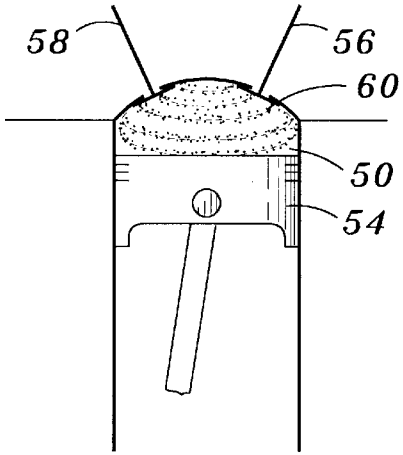

Referring now to FIGS. 4(*a*), 4(*b*), 4(*c*), 5(*a*), 5(*b*), 5(*c*), and 6 the operation of the spark plug 10 within the engine will now be described. During the intake stroke, as shown in FIG. 4(*a*), the intake valve 56 opens while the piston 54 travels downward in the cylinder 50, thereby permitting a fuel-air mixture 60 to flow into the cylinder 50. The fuel-air mixture 60 enters the cylinder 50 in a swirling fashion, traveling along the walls of the cylinder 50.

After completion of the intake stroke, the compression stroke begins. As can be seen from FIGS. 4(*b*) and 4(*c*), the intake valve 56 closes and the piston 54 moves upward along the cylinder 50. The fuel-air mixture 60 rises, swirling along the wall of the cylinder 50, and gathers in the main combustion chamber 52 as the mixture is progressively compressed. As the piston 54 nears the top-dead center of the compression stroke, e.g., as seen in FIGS. 4(*c*) and 6, further compression causes the fuel-air mixture 60 to thicken or get richer. The mixture 60 then fills sub-combustion chamber 30 via the ejection holes 40 and 42.

Figure 6:
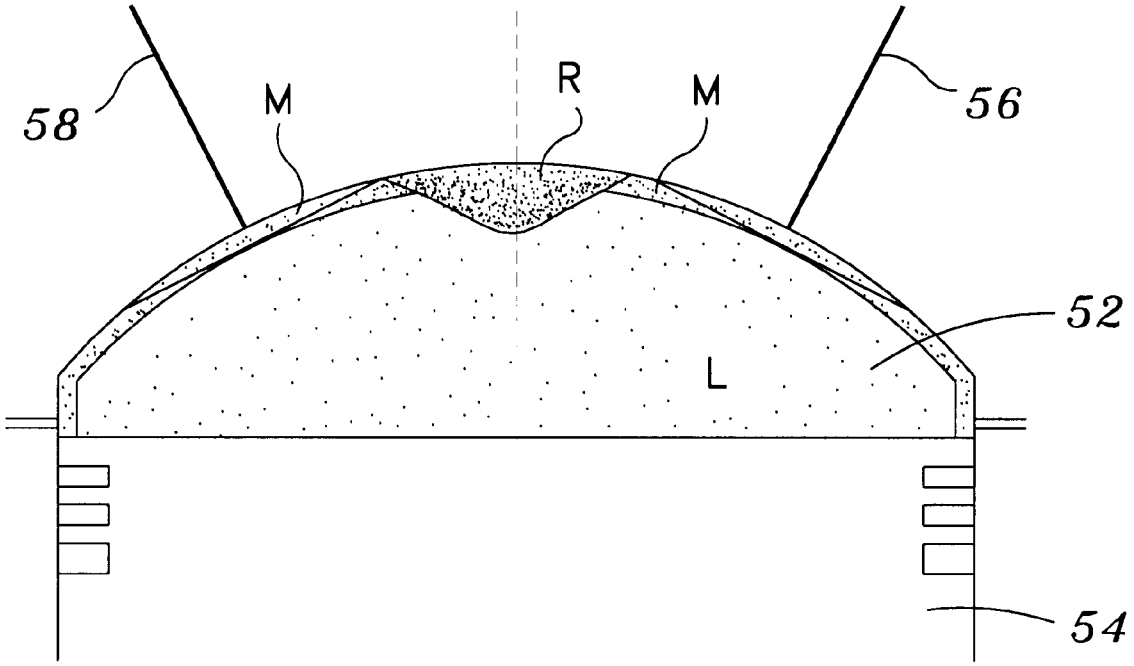
FIG. 6 is a schematic view of a cylinder illustrating the fuel-air mixture at dead-center compression.

Referring momentarily to FIG. 6, a graphic distribution of the fuel-air mixture 60 within the main combustion chamber 52.is shown. Generally, in the main combustion chamber 52 there are three regions of fuel-air mixtures. In region R, the fuel content is high, creating a thick, rich mixture. Along the top surface of the main combustion chamber 52 is region M, wherein the fuel content is relatively high, but still not as rich as the R region. Still further is the region L, which is the leanest of the three, i.e., it has the lowest fuel content.

Referring now to FIGS. 2 and 3, a high voltage created by an ignition coil (not shown) is applied to the spark plug 10 via a plug cable 62. The voltage differential created between the ground electrode 20 and center electrode 14 then causes an electrical discharge or spark to form within the electrode gap 24. The spark then causes the fuel-air mixture 60 to ignite within the sub-combustion chamber 30.

Figure 7C:
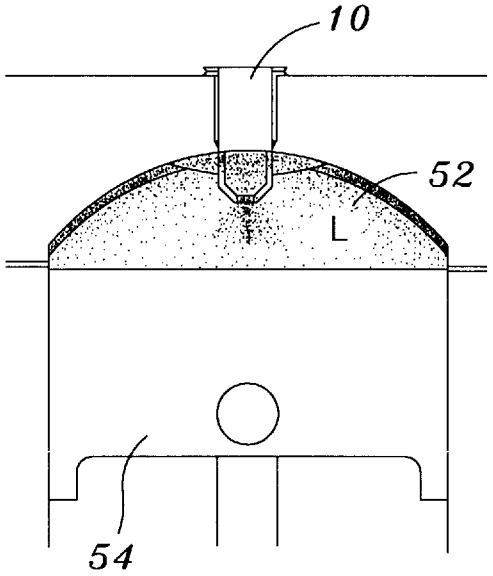
FIG. 7(*a*) is a schematic view of a cylinder and associated piston during dead-center compression.
Figure 7B:
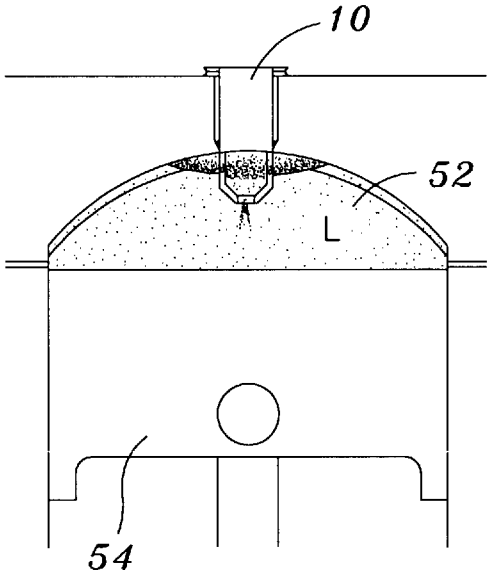
Figure 7A:
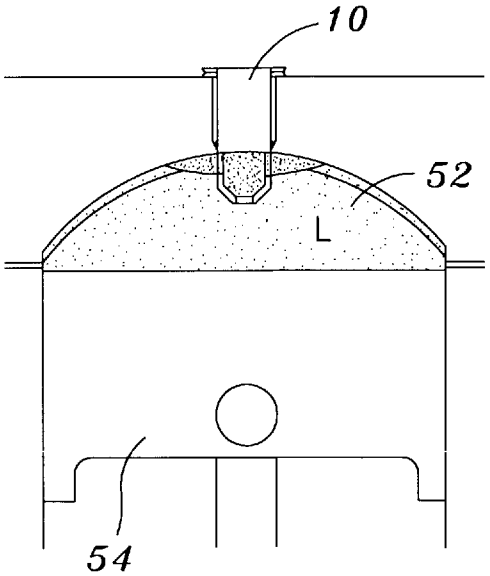

As can be seen from FIG. 7(*a*), the flame generated within the sub-combustion chamber 30 then initially spreads laterally outside the sub-combustion chamber 30 via the ejection holes 40. Consequently, region R is ignited. During this initial period, downward ejection of the flame through the ejection hole 42 is advantageously prevented from leaving the sub-combustion chamber 30 due to the wide dimensions of the ground electrode 20. As further combustion continues, the combustion pressure within the sub-combustion chamber 30 pushes out the mixture 60 into the main combustion chamber 52, to cause propagation of the flame.

Referring now to FIGS. 6, 7(*a*), 7(*b*), and 7(*c*), the flame initially spreads along the top surface of the main combustion chamber 52 where the mixture 60 is relatively thick, i.e., region R. After this region has ignited, regions M and L begin to ignite when, as seen in FIG. 7(*c*), the flame is ejected downward through the ejection hole 42.

Since the ejection holes 40 are located laterally adjacent to the point of ignition, i.e., in electrode gap 24, the flame travels quickly outside the sub-combustion chamber 52. As a result, the lean mixture contained in region L, which has the slowest burning speed, burns at approximately twice the speed of systems using conventional spark plugs.

Figure 5A:
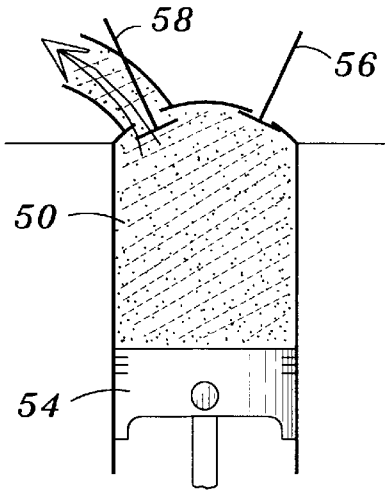
FIG. 5(*a*) is a schematic view of a cylinder and associated piston during the discharge cycle.
Figure 5B:
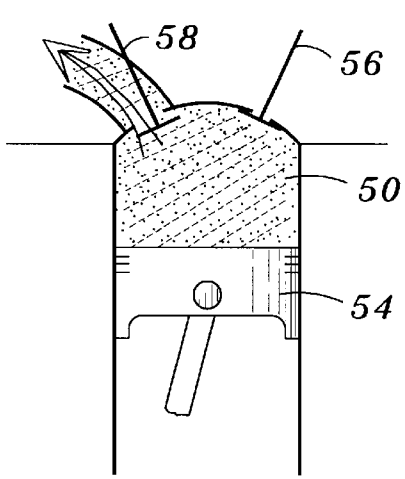
Figure 5C:
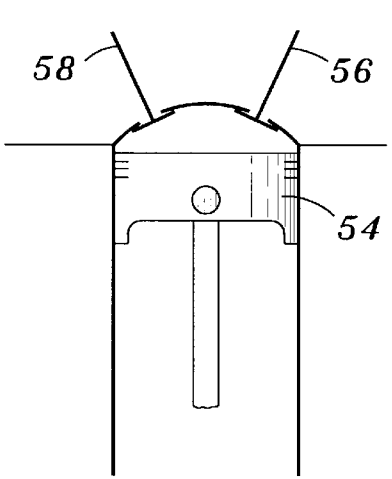

Referring now to FIGS. 5(*a*) through 5(*c*), the discharge stroke will now be described. After combustion of the fuel-air mixture 60, the piston 54 begins to rise within the cylinder 50 to expel the combustion gases through the opening created by the exhaust valve 58. The gases contained within the sub-combustion chamber 30 are also purged as well. The location of the ejection holes 40 along the annular walls 37 and the ejection hole 42 in the cap 38 advantageously enables the combustion gases to be completely ejected during the discharge stroke. Consequently, the quantity of combustion gases remaining in the main combustion chamber 52 is reduced, thereby minimizing the problem of misfiring associated with wet combustion. In addition, the location of the ejection holes 40 advantageously permits self-cleaning and self-adjustment of the electrode gap 24.

Thus, improved spark plugs for internal combustion engines have been disclosed having sub-combustion chambers. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A spark plug for an engine, comprising a ground electrode;

a center electrode spaced apart from the ground electrode to form an electrode gap; and a sub-combustion chamber enclosing the ground electrode and the center electrode and including an annular wall surrounding the electrode gap having a plurality of ejection holes laterally adjacent the gap, wherein at least two of the election holes are located in the annular wall such that the election holes intersect a plane perpendicular to the axis of the center electrode that passes through the electrode gap, and a cap extending from the annular wall with an election hole at the terminal end thereof.

2. A spark plug according to claim 1, the ground electrode having a width at its terminal end within the range of about 2.5 mm to about 3.5 mm.

3. A spark plug according to claim 1, the ejection holes having an internal diameter ranging from about 3.0 mm to about 4.0 mm.

4. A spark plug for an engine, comprising a ground electrode;

a center electrode and spaced apart from the ground electrode to form an electrode gap extending axially from the center electrode;

a sub-combustion chamber enclosing the ground electrode and the center electrode and including an annular wall surrounding the electrode gap having a plurality of ejection holes laterally adjacent the gap, wherein at least two of the ejection holes are located in the annular wall such that the election holes intersect a plane perpendicular to the axis of the center electrode that passes through the electrode gap, and a cap extending from the annular wall with an ejection hole at the terminal end thereof, the ground electrode having a width at its terminal end larger than the diameter of the center electrode so as to direct a combustion mixture laterally through the ejection holes.

5. A spark plug according to claim 4, the outer electrode having a width at its terminal end within the range of about 2.5 mm to about 3.5 mm.

6. A spark plug according to claim 5, the ejection holes having an internal diameter ranging from about 3.0 mm to about 4.0 mm.

7. A spark plug for use in fuel ignition systems, comprising:

a ground electrode;

a center electrode spaced apart from the ground electrode to form an electrode gap extending axially from the center electrode; and a sub-combustion chamber enclosing the ground electrode and the center electrode, said sub-combustion chamber further comprising:

(i) an annular wall that surrounds the electrode gap, said annular wall further including a plurality of ejection holes, wherein at least two of the ejection holes are located in the annular wall such that the ejection holes intersect a plane perpendicular to the axis of the center electrode and passing through the electrode gap, the ejection holes also being positioned circumferentially equidistant from each other; and (ii) a cap extending from said annular wall to an ejection hole axially from the center electrode.

8. A spark plug according to claim 7, the ground electrode having a width at its terminal end within the range of about 2.5 mm to about 3.5 mm.

9. A spark plug according to claim 7, the ejection holes having an internal diameter ranging from about 3.0 mm to about 4.0 mm.

* * * * *

UNITED STATES PATENT AND TRADEMARK OFFICE

CERTIFICATE OF CORRECTION

PATENT NO. : 6,013,973
DATED : January 11, 2000
INVENTOR(S) : Jun Sato

It is certified that error appears in the above-identified patent and that said Letters Patent is hereby corrected as shown below:

Column 5,
Lines 35, 36 and 39, please change "election" to -- ejection --.

Column 6,
Line 6, please change "election" to -- ejection --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*